US010267607B2

(12) United States Patent
Bootes et al.

(10) Patent No.: US 10,267,607 B2
(45) Date of Patent: Apr. 23, 2019

(54) MUNITION WITH OUTER ENCLOSURE

(71) Applicant: Raytheon Company, Waltham, MA (US)

(72) Inventors: Thomas H. Bootes, Tucson, AZ (US); George D. Budy, Tucson, AZ (US); Wayne Y. Lee, Santaquin, UT (US); Richard K. Polly, Tucson, AZ (US); Jason M. Shire, Tucson, AZ (US); Jesse T. Waddell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 173 days.

(21) Appl. No.: 15/117,899

(22) PCT Filed: Feb. 11, 2015

(86) PCT No.: PCT/US2015/015420
§ 371 (c)(1),
(2) Date: Aug. 10, 2016

(87) PCT Pub. No.: WO2015/175037
PCT Pub. Date: Nov. 19, 2015

(65) Prior Publication Data

US 2018/0156586 A1 Jun. 7, 2018

Related U.S. Application Data

(60) Provisional application No. 61/986,985, filed on May 1, 2014, provisional application No. 61/938,297, filed on Feb. 11, 2014.

(51) Int. Cl.
*F42B 12/20* (2006.01)
*F42B 12/22* (2006.01)
(Continued)

(52) U.S. Cl.
CPC ..... *F42B 12/204* (2013.01); *F42B 12/04* (2013.01); *F42B 12/22* (2013.01); *F42B 12/24* (2013.01);
(Continued)

(58) Field of Classification Search
CPC ..... F42B 12/32; F42B 12/204; F42B 12/24; F42B 12/22; F42B 12/04; F42B 25/00; F42C 19/02
(Continued)

(56) References Cited

U.S. PATENT DOCUMENTS 1,006,875 A * 10/1911 Puff ..... F42B 12/32 102/494
1,154,437 A * 9/1915 Rimailho ..... F42B 12/32 102/496
(Continued)

FOREIGN PATENT DOCUMENTS

CH 649627 A5 5/1985
DE 2557676 A1 6/1977
(Continued)

OTHER PUBLICATIONS

Office Action issued in corresponding Korean Application No. 10-2016-7024769 dated Jan. 30, 2018, and the English translation.
(Continued)

*Primary Examiner* — John Cooper
(74) *Attorney, Agent, or Firm* — Renner, Otto, Boisselle & Sklar, LLP

(57) ABSTRACT

A munition may include a warhead, such as a penetrator warhead, enclosed in airframe. The airframe may enable connection to standard mountings, and/or to standard nose kits or tail kits. The airframe may have preformed fragments in it, packed between the airframe and the warhead. The preformed fragments may be loose, may be packed in a
(Continued)

potting material, or may be in flexible bags. The fragments may enhance performance of the munition. The warhead may also contain preformed fragments.

23 Claims, 7 Drawing Sheets

(51) Int. Cl.
*F42B 25/00* (2006.01)
*F42C 19/02* (2006.01)
*F42B 12/04* (2006.01)
*F42B 12/24* (2006.01)
*F42B 12/32* (2006.01)

(52) U.S. Cl.
CPC ..... *F42B 12/32* (2013.01); *F42B 25/00* (2013.01); *F42C 19/02* (2013.01)

(58) Field of Classification Search
USPC ..... 102/506, 495, 496, 382
See application file for complete search history.

(56) References Cited

U.S. PATENT DOCUMENTS 1,300,333 A * 4/1919 Berry ..... F42B 12/58 102/383
2,337,765 A * 12/1943 Nahirney ..... F42B 12/204 102/389
2,972,950 A * 2/1961 Welanetz ..... F42B 12/30 102/495
3,134,330 A 5/1964 Batou
3,263,612 A * 8/1966 Throner, Jr. ..... B23Q 1/68 102/496
3,474,731 A * 10/1969 Thomanek ..... F42B 12/10 102/476
3,489,088 A * 1/1970 Von Ballmoos ..... F42B 12/32 102/496
3,744,419 A 7/1973 Hand
3,815,504 A * 6/1974 Tieben ..... F42B 12/32 102/496
3,820,464 A 6/1974 Dixon
3,981,243 A 9/1976 Doris, Jr.
4,063,512 A 12/1977 Davis
4,106,410 A * 8/1978 Borcher ..... F42B 12/22 102/495
4,327,643 A * 5/1982 Lasheras Barrios .... F42B 12/32 102/473
4,353,305 A * 10/1982 Moreau ..... F42B 12/34 102/519
4,430,941 A * 2/1984 Raech, Jr. ..... F42B 12/64 102/494
4,524,696 A * 6/1985 Altenau ..... F42B 12/32 102/473
4,592,283 A 6/1986 Hellner et al.
4,648,323 A 3/1987 Lawther
4,664,035 A 5/1987 Osofsky
4,693,317 A 9/1987 Edwards et al.
4,882,996 A * 11/1989 Bock ..... F42B 12/32 102/496
4,896,607 A 1/1990 Hall et al.
5,078,051 A 1/1992 Amundson
H1048 H * 5/1992 Wilson ..... 102/364
5,117,759 A 6/1992 Henderson et al.
5,131,329 A 7/1992 Lips et al.
5,305,505 A 5/1994 Ruhlman
5,313,890 A * 5/1994 Cuadros ..... F42B 12/32 102/393
5,535,679 A * 7/1996 Craddock ..... F42B 12/32 102/389
5,565,648 A * 10/1996 Lindstadt ..... F42B 12/16 102/476
5,656,792 A 8/1997 Rentzsch et al.
5,698,814 A 12/1997 Parsons et al.
5,717,397 A 2/1998 Ruszkowski, Jr.
5,852,256 A 12/1998 Hornig
5,939,662 A 8/1999 Bootes et al.
6,105,505 A 8/2000 Jones
6,135,028 A * 10/2000 Kuhns ..... F42B 12/06 102/265
6,186,072 B1 2/2001 Hickerson, Jr. et al.
6,279,482 B1 * 8/2001 Smith ..... F42B 12/60 102/357
6,374,744 B1 4/2002 Schmacker et al.
6,389,977 B1 * 5/2002 Schmacker ..... F42B 25/00 102/382
6,484,642 B1 11/2002 Kuhns et al.
6,523,477 B1 2/2003 Brooks et al.
6,598,534 B2 * 7/2003 Lloyd ..... F41H 11/02 102/494
6,601,517 B1 8/2003 Guirguis
6,619,210 B1 9/2003 Spivak et al.
6,659,013 B1 12/2003 Kellner
7,066,093 B2 * 6/2006 Ronn ..... F42B 12/32 102/489
7,152,532 B2 12/2006 Conrad
7,231,876 B2 6/2007 Kellner
7,614,348 B2 * 11/2009 Truitt ..... F42B 12/50 102/491
7,726,244 B1 * 6/2010 Lloyd ..... F41H 11/12 102/402
7,971,533 B1 7/2011 Berlin et al.
8,061,275 B1 11/2011 Gold
8,161,884 B1 4/2012 Kokodis et al.
8,176,849 B1 5/2012 Gold et al.
8,191,479 B2 6/2012 Ruhlman et al.
8,234,979 B1 8/2012 Falabella et al.
8,387,539 B1 3/2013 Maines
8,671,840 B2 3/2014 Scheid et al.
8,701,557 B2 4/2014 Biggs et al.
9,291,437 B2 3/2016 Bonnstetter et al.
9,423,226 B2 8/2016 Cillaut et al.
9,683,822 B2 * 6/2017 Kerns ..... F42B 12/34
9,816,793 B2 11/2017 Budy et al.
2003/0167956 A1 9/2003 Kellner
2003/0172833 A1 * 9/2003 Ronn ..... F42B 12/22 102/489
2005/0087088 A1 * 4/2005 Lacy ..... F42B 12/24 102/495
2005/0109234 A1 * 5/2005 Lloyd ..... F42B 12/32 102/497
2005/0115450 A1 6/2005 Lloyd
2005/0223930 A1 * 10/2005 Bootes ..... F42B 12/08 102/473
2005/0235862 A1 * 10/2005 Gousman ..... F42B 12/22 102/493
2008/0019386 A1 1/2008 Chen et al.
2010/0032515 A1 2/2010 Geswender et al.
2010/0199875 A1 * 8/2010 Weihrauch ..... F42B 12/208 102/492
2011/0162548 A1 7/2011 Berlin et al.
2012/0017795 A1 1/2012 Dryer et al.
2012/0227609 A1 9/2012 Volkmann
2012/0291651 A1 11/2012 Haumann et al.
2014/0299012 A1 10/2014 Odintsov
2016/0025467 A1 1/2016 Botthof et al.
2016/0377396 A1 12/2016 Bootes et al.

FOREIGN PATENT DOCUMENTS

EP 1001244 A1 5/2000
EP 1316774 A1 6/2003
EP 1367358 A2 12/2003
EP 1864960 A2 4/2007
EP 2095059 B1 6/2010
FR 2910612 A1 6/2008
GB 2384291 A 11/1993
JP 2008-261627 A 10/2006
WO 98/30863 A1 7/1998
WO 9830863 A1 7/1998
WO 0203008 A1 1/2002

(56) References Cited

FOREIGN PATENT DOCUMENTS

| | | | |
|---|---|---|---|
| WO | 2008089078 | A2 | 7/2008 |
| WO | 2008096069 | A1 | 8/2008 |
| WO | 2009102254 | A1 | 8/2009 |
| WO | 2011054361 | A1 | 5/2011 |
| WO | 2011054361 | A1 | 12/2011 |
| WO | 2015175036 | A2 | 11/2015 |
| WO | 2015175037 | A2 | 11/2015 |
| WO | 2015175038 | A2 | 11/2015 |
| WO | 2015175039 | A2 | 11/2015 |
| WO | 2015175040 | A2 | 11/2015 |
| WO | 2016022181 | A1 | 2/2016 |
| WO | 2016022199 | A1 | 2/2016 |

OTHER PUBLICATIONS

International Search Report for corresponding International Application No. PCT/US2015/015420 dated Feb. 3, 2016.
Written Opinion for corresponding International Application No. PCT/US2015/015420 dated Feb. 3, 2016.

* cited by examiner

MUNITION WITH OUTER ENCLOSURE

This application claims priority to U.S. Provisional Application 61/938,297, filed Feb. 11, 2014, and to U.S. Provisional Application 61/986,985, filed May 1, 2014. Both of these applications are incorporated by reference in their entireties.

FIELD OF THE INVENTION

The present invention generally relates to munitions, such as for use in penetrating hard targets or as area weapons relying on fragmentation.

DESCRIPTION OF THE RELATED ART

Munitions come in any of a wide variety of configurations. Sometimes it is required or advantageous for multiple types of munitions to be configured to mate with standard components and/or standard delivery systems.

In addition, weapons for penetrating hard targets, such as buildings or fortifications having reinforced concrete walls, have generally used steel casings to survive challenging impact conditions against hardened target structures. Using solid steel cased cylindrical wall structures that protect the explosive payload during penetration have been the standard. However, this approach results in relatively low numbers of large naturally formed steel cased fragments upon warhead detonation inside the hardened target.

SUMMARY OF THE INVENTION

According to an aspect of the invention, a munition includes: a penetrator warhead and an enclosure around the outside of the penetrator casing, enclosing the penetrator warhead. The penetrator warhead includes: a penetrator casing; and an explosive within the penetrator casing.

In some embodiments the enclosure is a clamshell enclosure.

According to another aspect of the invention, a munition includes a warhead that includes: a casing; and an explosive within the casing. The warhead also includes an enclosure around the outside of the casing, enclosing the warhead. The enclosure includes solid fragments that are propelled outward when the explosive is detonated.

In some embodiments the solid fragments are in openings or pockets within the enclosure.

In some embodiments the solid fragments are enclosed as parts of self-contained fragmentation packs that are located in the openings or pockets.

In some embodiments the fragmentation packs are flexible.

In some embodiments the fragmentation packs include a fragmentation pack casing that contains the fragments.

In some embodiments the fragmentation pack casing is a sealed fragmentation pack casing.

In some embodiments the fragmentation pack casing is a metal and/or plastic fragmentation pack casing.

In some embodiments the fragments are in cast fragment blocks that include multiple of the fragments held together by a binder.

In some embodiments the cast fragment blocks are adhesively secured to the enclosure.

In some embodiments the cast fragment blocks are mechanically secured to the enclosure.

In some embodiments a metallic powder material is within the enclosure.

In some embodiments the metallic powder material includes aluminum, magnesium, zirconium or titanium.

In some embodiments the metallic powder material is an incendiary material.

In some embodiments the metallic powder material is within a flexible bag or casing.

According to yet another aspect of the invention, a munition includes an airframe, and a warhead or munition within the airframe. The airframe has openings therein, and there are fragments in the openings.

In some embodiments the penetrator casing has a nose, and an aft section extending back from the nose; the reduced-thickness portions are parts of the aft section; and the nose has a thickest portion that is at least twice the thickness of the portions of the casing that are adjacent the reduced-thickness portions.

In some embodiments the aft section is substantially cylindrical.

In some embodiments the elongate reduced-thickness portions are parallel to one another.

In some embodiments the elongate reduced-thickness portions extend in straight lines.

In some embodiments the elongate reduced-thickness portions extend substantially parallel to a longitudinal axis of the warhead.

In some embodiments the elongate reduced-thickness portions are portions in which the casing has holes therein.

In some embodiments the holes include a series of longitudinal holes therein, separated circumferentially around the penetrator casing.

In some embodiments the elongate reduced-thickness portions are portions in which the casing has grooves therein. The grooves may be on an inside surface of the casing. Alternatively or in addition the grooves may be on an outside surface of the casing.

In some embodiments the warhead includes a lethality-enhancement material located at the reduced-thickness portions of the penetrator casing. The lethality-enhancement material may include solid fragments that are projected by the warhead when the explosive is detonated. The lethality-enhancement material may include an energetic material that releases energy when the explosive is detonated.

In some embodiments the solid fragments include spherical fragments.

In some embodiments the solid fragments include fragments in casings.

In some embodiments the solid fragments include fragments having flat bodies.

In some embodiments fragments having flat bodies are star-shape fragment having a series of protrusions extending from each of the flat bodies.

In some embodiments the protrusions are edged protrusions.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A munition may include a warhead, such as a penetrator warhead, enclosed in airframe. The airframe may enable connection to standard mountings, and/or to standard nose kits or tail kits. The airframe may have preformed fragments in it, packed between the airframe and the warhead. The preformed fragments may be loose, may be packed in a potting material, or may be in flexible bags. The fragments may enhance performance of the munition. The warhead may also contain preformed fragments.

In the following description, a general description of a munition with a penetrator warhead is given first, with the munition including an airframe that encloses the warhead. Details of the airframe and preformed fragments that may located in the airframe are then discussed. It should be understood that the airframe described below may be used in combination with other sorts of warheads (other than penetrator warheads).

Figure 1:
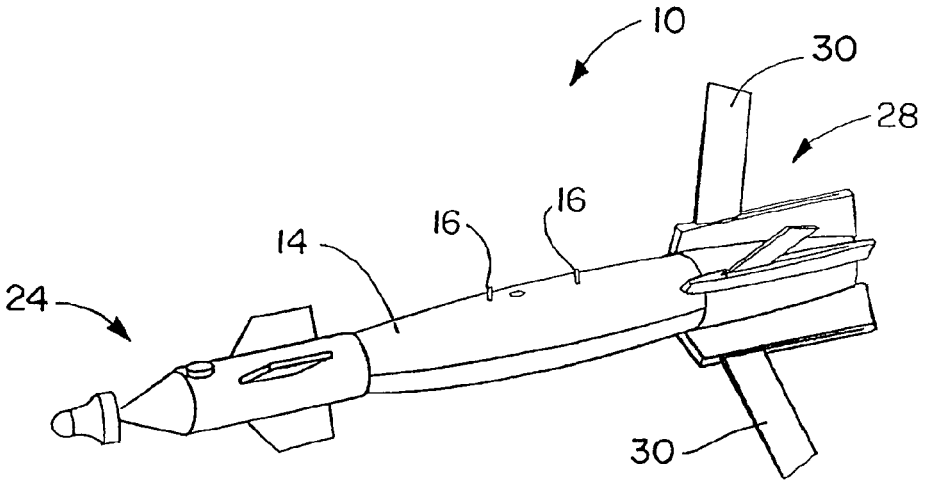
FIG. 1 is an oblique view of a munition in accordance with the present invention.
Figure 2:
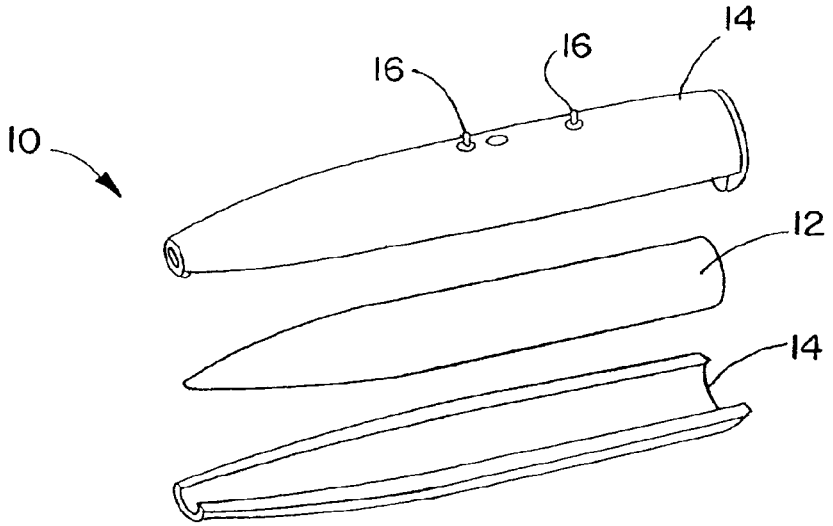
FIG. 2 is an exploded view showing parts of the munition of FIG. 1.
Figure 3:
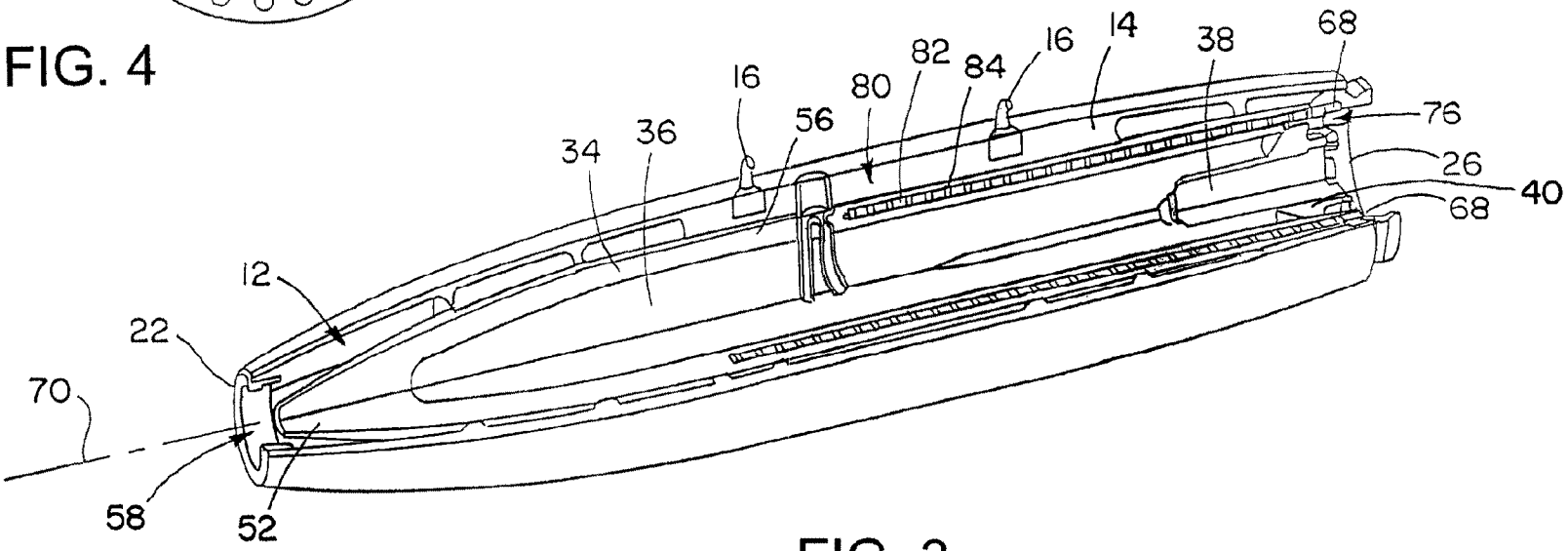
FIG. 3 is an oblique partial cutaway view showing details of a warhead of the munition of FIG. 1.

Referring initially to FIGS. 1-3, a munition 10, such as a missile or guided bomb, has a warhead 12 that is contained within an airframe 14 that has connection lugs 16 for connection to an aircraft or other platform for launching the munition 10. The airframe 14 has a forward connection 22 for receiving a guidance nose kit 24 (for example), and an aft connection 26 for receiving (for example), a tail kit 28 with deployable fins 30. The airframe 14 may be configured for using a standard weapons mount on a launch platform that is also able to receive other types of weapons. The connections 22 and 26 may be standard connections that are similar to those used for other munitions, thus enabling use of standard nose and tail kits that may be used with other sorts of munitions. The airframe 14 may be in the form of a pair of clamshell halves that fit around the warhead 12, and may be made of a relatively lightweight material, such as aluminum.

The warhead 12 has a penetrator casing 34 that encloses an explosive 36. There may also be an asphaltic liner between the penetrator casing 34 and the explosive 36. The asphaltic liner serves as a sealing material and protective layer for the explosive 36 during storage, transportation and target penetration. The explosive 36 is detonated by a fuze 38 that is at an aft end of the explosive 36, in a fuzewell 40. The casing 34 has a forward nose 52, and an aft section 56 extending back from the nose 52. In the illustrated embodiment, the forward nose 52 of the penetrator case 34 is solid in nature, a monolithic structure with no cutout or through holes to accommodate forward mounted fuzing such as that used in general purpose bomb cases. The forward nose 52 is thickest at an apex 58 of the nose 52, and has a thickness that reduces the farther back you go along the casing 34, tapering gradually to the thickness of the substantially cylindrical aft section 56. The nose 52 may have a maximum thickness that is at least twice the thickness of the thickest part of the casing 34 in the cylindrical aft section 56.

Figure 4:
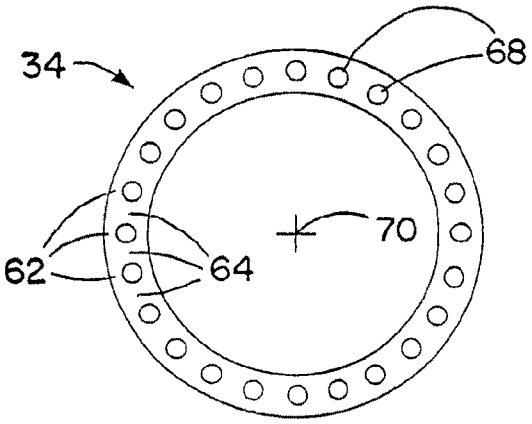
FIG. 4 is an end view showing details of a casing of the warhead of FIGS. 2 and 3.

With reference in addition to FIG. 4, the aft section 56 has a series of reduced-thickness portions 62 that are adjacent to other portions 64 of the aft section 56 that do not have a reduced thickness. The reduced-thickness portions 62 introduce weakness into parts of the penetrator casing 34, facilitating break-up of the casing 34 when the explosive 36 is detonated. This may enhance the production of fragments from all or part of the casing 34 when the explosive 36 is detonated, enhancing the lethality of the warhead 12.

In the illustrated embodiment the reduced-thickness portions 62 are a series of holes 68 that are parallel to a longitudinal axis 70 of the warhead 12. The holes 68 do not intersect with one another, and are distributed circumferentially about the aft section 56. The holes 68 may be substantially evenly distributed in the circumferential direction around the aft section 56, although a non-even distribution is a possible alternative. The use of the holes 68 to produce the reduced-thickness portions 62 is just one possible configuration. Alternatives, such as notches or grooves on the inner and/or outer surfaces of the aft section 56, may also be used. These alternatives are discussed further below.

The reduced-thickness portions 62 in the illustrated embodiment are non-intersecting, and are elongate, having lengths (in the axial or longitudinal direction) that are for example of at least ten times their widths (in the circumferential direction). The reduced-thickness portions 62 may be substantially identical in their lengths, widths, and reduction in thickness of material, although alternatively the reduced-thickness portions 62 may vary from one to another with regard to one or more of these parameters.

The holes 68 may be filled with a lethality-enhancement material 76, to further increase the effectiveness of the warhead 12. In the illustrated embodiment, the holes 68 are filled with preformed fragments 80. The fragments 80 include two types of fragments, with steel preformed fragments 82 alternating with zirconium-tungsten preformed fragments 84, and with the fragments 82 having a different size and shape from the fragments 84. More broadly, the fragments 80 may include fragments with different materials, different shapes, and/or different sizes, although as an alternative all of the fragments may be substantially identical in material, size, and shape. Other materials, such as spacers, may be placed between the hard preformed fragments.

One advantage of the munition 10 is that it provides flexibility and adaptability for fragment sizes, weights, and shapes. These parameters are tailorable in accordance with mission requirements. Smaller fragments, for example the size of pebbles, are more suitable for localized full coverage, while larger fragment sizes allow more observable damages within the target site.

The fragments 80 are projected outward from the warhead 12 when the explosive 36 is detonated. Thus the warhead 12 has the characteristics of both a penetrator weapon and a fragmentation weapon. The penetrator casing 34 remains intact as the warhead 12 strikes a hard target, such as a concrete building, allowing the warhead to penetrate into the hard target, perhaps to an interior space that may be occupied by targeted personnel. Then the fuze 38 detonates the explosive 36. This causes the casing 34, because of the weakness introduced by the reduced-thickness portions 62, to break up into fragments that can do damage within the hard target. In addition the preformed fragments 80 may enhance the fragmentation effect of the warhead 12.

The lethality-enhancement material 76 may alternatively or in addition include energetic materials, such as chemically-reactive materials. For example, the fragments 80 may be spaced apart, with energetic material placed between adjacent of the fragments within the holes 68. The energetic material may be or may include any of a variety of suitable explosives and/or incendiaries, for example hydrocarbon fuels, solid propellants, incendiary propellants, pyroforic metals (such as zirconium, aluminum, or titanium), explosives, oxidizers, or combinations thereof. Detonation of the explosive 36 may be used to trigger reaction (such as detonation) in the energetic material that is located at the reduced-thickness portions 62. This adds further energy to the detonation, and may aid in propelling the fragments 80 and/or in breaking up the penetrator casing 34 into fragments.

Many alternatives are possible for the arrangement and type of materials. The energetic materials may be placed between every adjacent pair of the fragments 80, or next to every second fragment, or every third fragment, etc. In addition, the materials may include substances that could neutralize or destroy chemical or biological agents.

The lethality-enhancement material 76 may be omitted from the holes 68, if desired, with holes 68 just filled with air (for example) or gases, or liquids. Without the lethality-enhancement material 76, the enhanced fragmentation of the warhead 12 comes from the breakup of the penetrator casing 34 into smaller fragments due to the reduced thickness areas of the penetrator casing 34.

The penetrator casing 34 may be made out of a suitable metal, such as a suitable steel (for example 4340 steel) or another hard material, such as titanium. Aluminum and composite materials are other possible alternatives. An example of a suitable material for the explosive 36 is PBXN-109, a polymer bonded explosive.

The holes 68 may be through holes, or may be blind holes that only go to a specific depth. The depth of blind holes may all be the same, or may vary according to achieve some desired effect, or due to system-level requirements such as varying hole length due to aircraft mounting lugs for example. The holes 68 may be made by machining, for example by drilling, or may be made by other suitable processes, such as acid etching. In the illustrated embodiment the holes 68 are only in the aft casing section 56, but as an alternative there may be holes or other reduced-thickness portions of parts of the nose 52.

Figure 5:
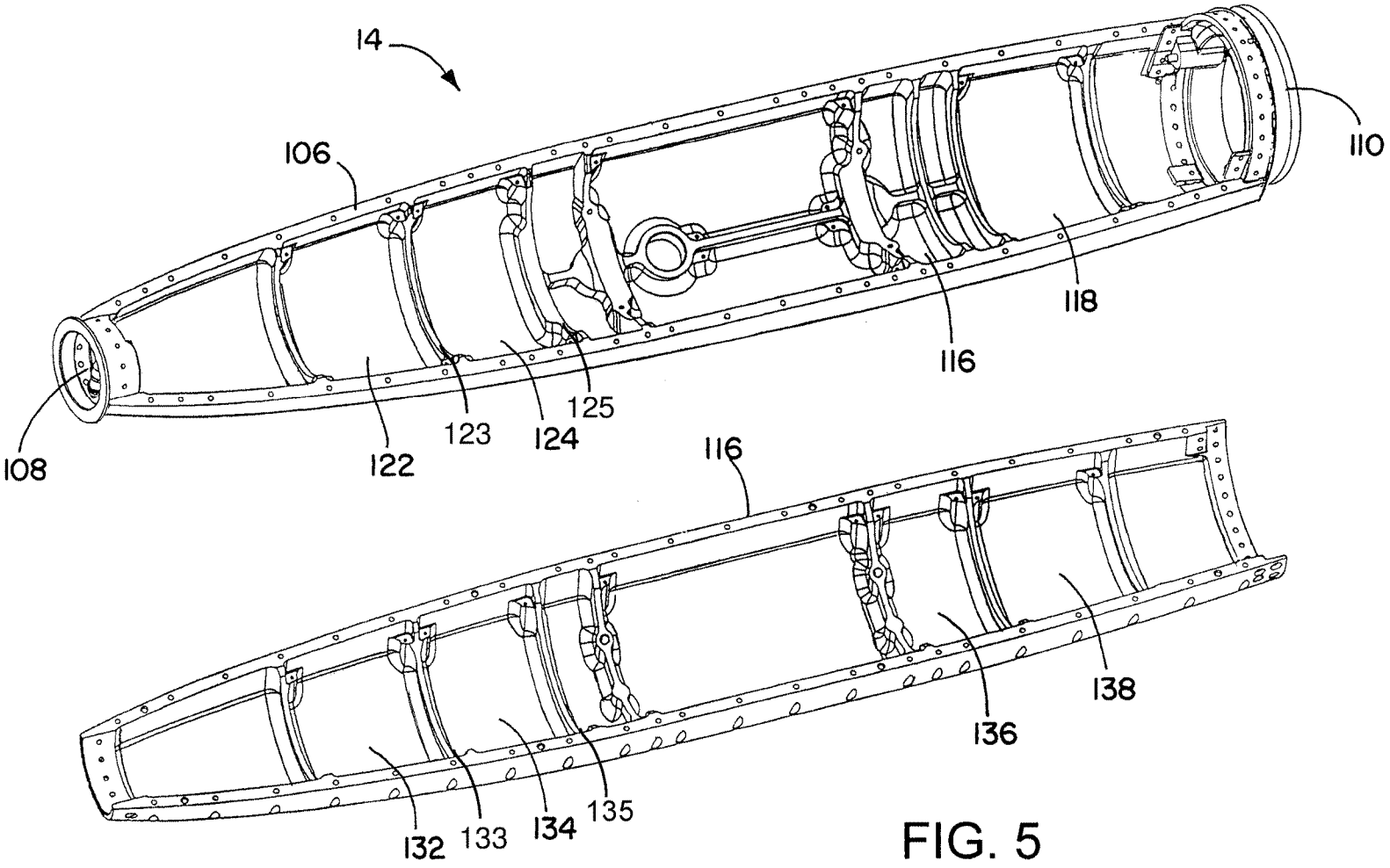
FIG. 5 is an oblique view of parts of a clamshell enclosure that is part of a munition, according to an embodiment.

FIG. 5 shows further details of the clamshell enclosure or airframe 14. The enclosure 14 includes an upper assembly 102, which includes an upper clamshell piece 106, as well as a nose ring 108 and a tail ring 110. A lower clamshell piece 116 engages the parts of the upper assembly 102 to enclose the warhead. The pieces 106 and 116 may be made of aluminum alloy, or another suitable material. The pieces 106 and 116 together define a series of bays (openings or cavities) for receiving fragments and/or other lethality enhancement materials, in any of a variety of forms. The upper clamshell piece 106 has upper bay portions 122, 124, 126, and 128, and the lower clamshell piece 116 has lower bay portions 132, 134, 136, and 138, from front to back in both pieces.

Figure 8:
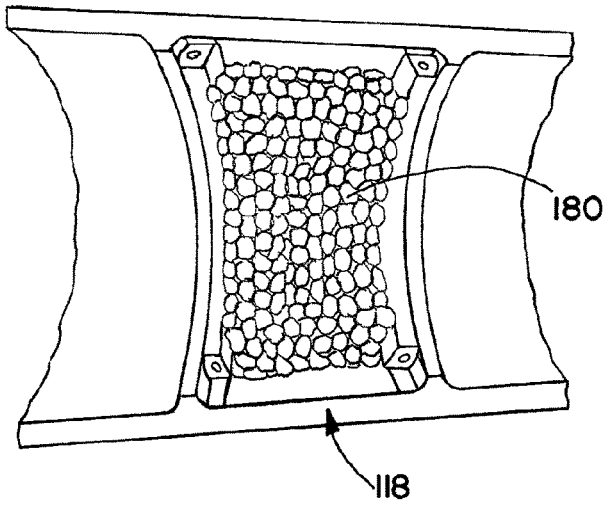
FIG. 8 illustrates a first step in placing material in a bay portion of one of the clamshell pieces of FIG. 5.

Lethality may be enhanced by providing fragmentation packs in pockets or openings, such as the bay portions 122-138, in the airframe or enclosure 14. The pockets or openings may be defined longitudinally (forward and aft) by circumferentially-extending ribs of the enclosure, for example with ribs 123 and 125 defining the forward and aft ends of the bay portion 124, and with ribs 133 and 135 defining the forward and aft ends of the bay portion 134. The fragmentation packs 190 may be enclosed packages containing fragments and possibly other lethality enhancement materials, such as explosives, and are shown in FIG. 8, described below.

The fragments enclosed in the packs may be similar in material and other aspects to the various fragments 80 (FIG. 4) described above. Additional material in the fragmentation packs may include any of the other lethality-enhancement materials 76 (FIG. 4) described above, such as energetic material. The fragmentation pack casing for the fragmentation packs may include any of a variety of suitable material, such as suitable metal and/or plastic materials. The fragmentation packs may be deformable to aid in placement of the fragmentation packs in the pockets. The fragmentation packs may all be substantially identical, or there may be different sizes and/or shapes for the fragmentation packs to be placed in different of the pockets defined by the bay portions of the clamshell pieces.

As an alternative to (or in addition to) the fragmentation packs, fragments may be otherwise placed in the openings or pockets, in order to increase lethality. Fragments that are not prepackaged may be placed in the openings, for example with a potting material or covers to keep the fragments within the openings. The fragments placed in openings may be similar to the fragments within the fragmentation packs, as described above. In addition, other lethality-enhancement material, such as that described above, may also be packed into the openings.

Figure 6A:
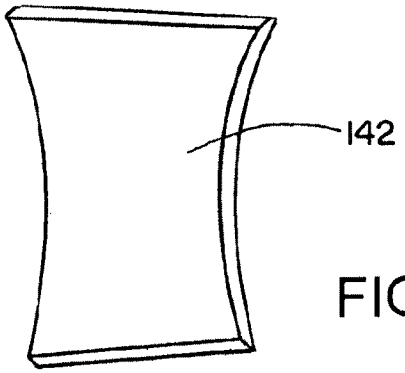
FIG. 6A is an oblique view of a fragment block that may be used in an embodiment of the munition of FIG. 1.
Figure 6B:
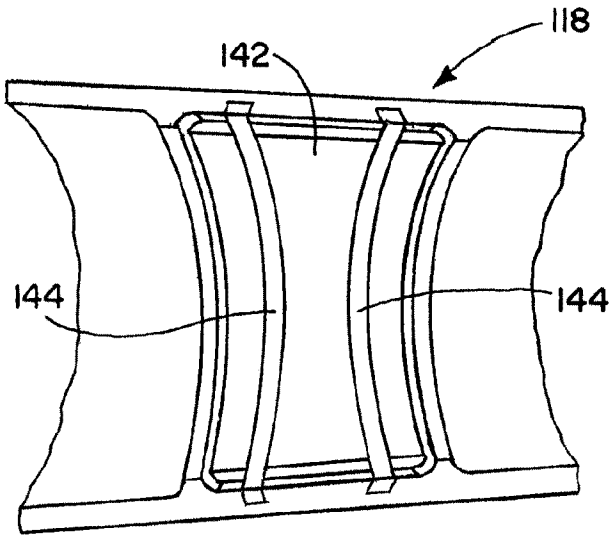
FIG. 6B is an oblique view showing one possible way of securing the fragment block of FIG. 6A in a bay portion of a clamshell enclosure.

FIGS. 6A and 6B illustrate one such alternative, a cast fragment block 142. The block 142 may be cast into a shape that fits into one of the bay portions 122-138 (FIG. 5). A mold may be made corresponding to the shape of the bay portion to be filled, with different of the bay portions having different molds (with different shapes). The mold may then be filled with a mixture that includes one or more the various types of fragments described elsewhere herein. The mixture may include the fragments (for example two sizes of steel shot, heavy shot, and tungsten alloy fragments, more broadly fragments of multiple sizes, shapes, and/or materials), with a binder material. Examples of suitable binder materials include EPOCAST (a pourable epoxy resin material) and CLEAR FLEX (a urethane-based material). Epoxy-based binders, or energetic binder materials (e.g., aluminumpolytetrafluoroethylene (PTFE, such as sold under the trademark TEFLON) based materials. Other materials, such as incendiary or pyrophoric materials, may also be included in the mixture. One desirable characteristic of the binder material is that it not unduly inhibit separation or singulation of the fragments when the explosive within the munition is detonated.

FIG. 6A shows the fragment block 142 after it has been removed from a mold. The block 142 may then be placed in an appropriate bay portion, such as the bay portion 118 shown in FIG. 6B. The block 142 may be adhesively secured in the bay portion 118 with a suitable glue. Alternatively or in addition the block 142 may be at least in part mechanically secured in the bay portion 118, for example being secured by straps 144, as shown in FIG. 6B. Other sorts of mechanical securement may be used instead or in addition to such straps, for instance a sheet metal plate across the block 142 to hold the block 142 in the bay portion 118.

The composition of the cast fragment blocks, such as the cast fragment block 142, may be varied to achieve different effects. Different types fragments or amounts of fragments may be used to achieve different weights. In addition, differences in sizes and/or types of fragments may produce different fragmentation effects.

Figure 7A:
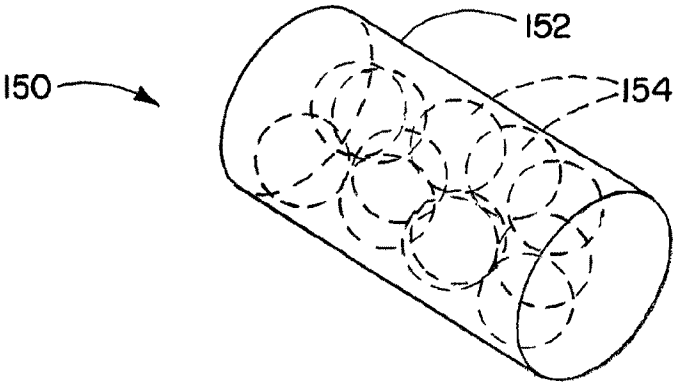
FIG. 7A is an oblique view of a cartridge that may be used as part of fragments in the munition of FIG. 1.
Figure 7B:
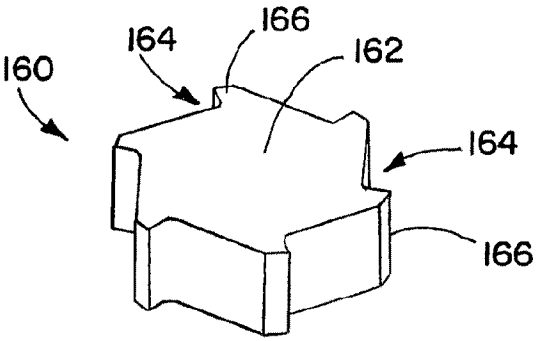
FIG. 7B is an oblique view of a star-shape fragment that may be used as part fragments in the munition of FIG. 1.

FIGS. 7A and 7B show examples of types of fragments that might be used as the fragments 80 (FIG. 3), or as the fragments in the fragmentation packs (or loose fragments or potted fragments) or the fragment blocks that are placed in the bay portions 122-138 (FIG. 5) of the airframe 14. FIG. 7A shows a cartridge 150 that includes a casing 152, and a series of small fragments 154 (spheres in the illustrated embodiment) within the casing 152. The small fragments 154 may have many alternative shapes, such as cubes and/or thin cylinders and/or other shapes. Other materials, such as pyrophoric materials contained within cylindrical cartridges. The casing 152 may have various lengths and/or diameters.

FIG. 7B shows an example of a star-shape fragment 160. The star-shape fragment 160 have a flat body 162 with a series of flutes 164 that produce edged protrusions 166. When ejected from a munition, such as the munition 10, the star-shape fragments 160 may spin during flight, allowing stable flight over a considerable distance. The edged protrusions 166 may facilitate the star-shape fragments 160 penetrating objects that they strike. The protrusions 166 may also aid in rupturing or otherwise opening up cartridge casings, such as the casing 152 (FIG. 7A) of the cartridge 150 (FIG. 7A), to release the fragments 154 (FIG. 7A) within the casing 152. The protrusions 166 may have any of a variety of suitable shapes, for example having barbed shapes that facilitate penetration and destruction of objects that the star-shape fragments 160 strike. In the illustrated embodiment the fragment 160 has six of the protrusion 166, but flat-bodied fragments with other numbers of protrusions are possible as alternatives. The star-shape fragment 160 may be made of similar materials to those of the other fragments described herein.

Figure 9:
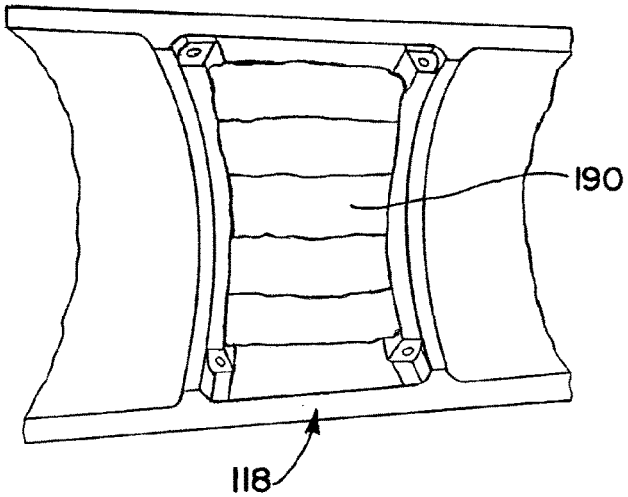
FIG. 9 illustrates a second step in placing material in a bay portion of one of the clamshell pieces of FIG. 5.
Figure 10:
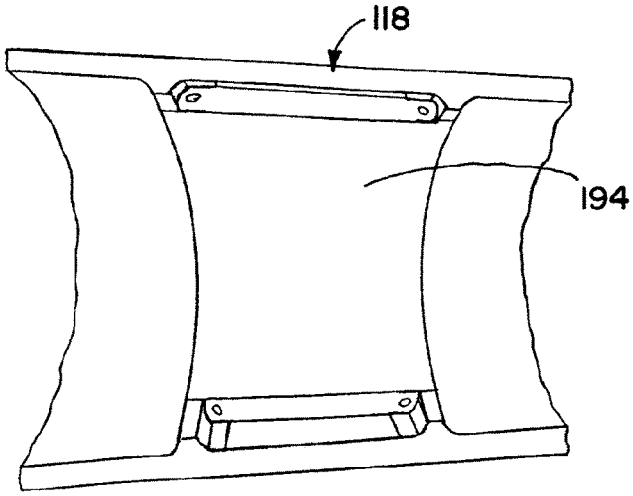
FIG. 10 illustrates a third step in placing material in a bay portion of one of the clamshell pieces of FIG. 5.

FIGS. 8-10 illustrate a process of filling one of the bay portions 122-138 (FIG. 5), the bay portion. In FIG. 8 fragments 180 are bonded to the inside surface of one of the clamshell pieces at the bay portion 118. The fragments may be spherical fragments, such as reactive material coated metal alloy balls, and may be bonded to the clamshell piece using polysulfide or a polysulfide compound.

In FIG. 9 bags or packs 190 of materials are placed on top of the layer of fragments 180 shown in FIG. 8. The packs 190 shown in FIG. 9 are examples of the fragmentation packs described earlier. The packs 190 in FIG. 9 are plastic bags that enclose lethality enhancement material. The packs may include bags containing metallic powder materials, such as aluminum, magnesium, zirconium, titanium or other reactive materials, for example providing incendiary or enhanced blast effects by being compacted in a suitable binder material. The bags may also include one or more bags containing solid fragments, such as spherical fragments, for example made of reactive material coated steel or tungsten alloy balls, or another suitable solid material.

In FIG. 10 the bay is sealed to keep the fragments and the packs (bags) in place. The bay may be sealed by a solid material, such as a sheet of aluminum 194. The solid-material shell may be bonded to the clamshell piece and/or the packs with polysulfide (or another suitable adhesive), and then mechanically fastened to keep it in place, such as with a series of screws or bolts.

The configuration and method shown in FIGS. 8-10 is only one example of possible configurations. Many alternative configurations and materials are possible, some of which are described elsewhere herein.

Figure 11:
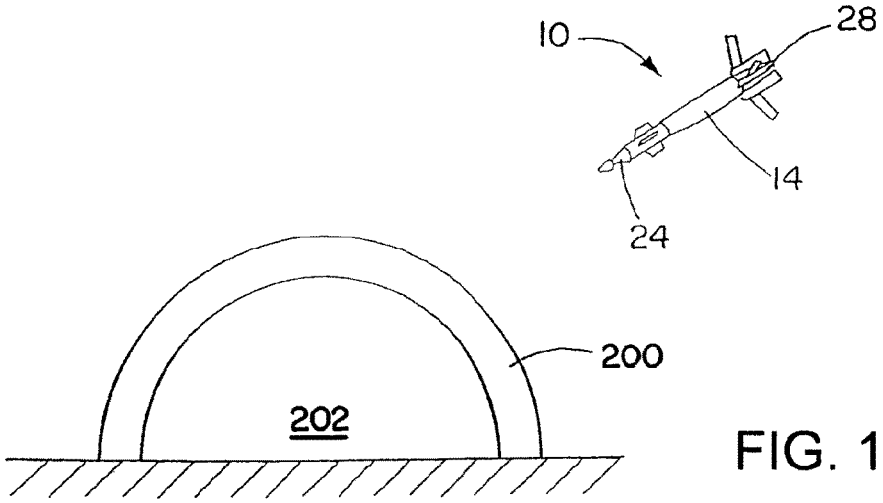
FIG. 11 is a side view illustrating a first step in the use of the munition of FIG. 1 as a hard target penetrator.
Figure 12:
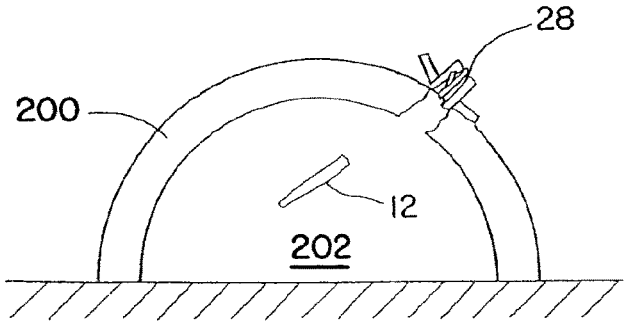
FIG. 12 is a side view illustrating a second step in the use of the munition as a hard target penetrator.
Figure 13:
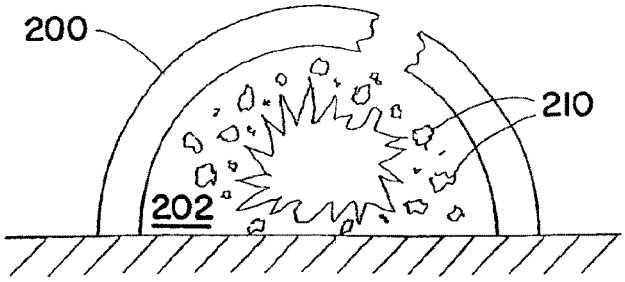
FIG. 13 is a side view illustrating a third step in the use of the munition as a harden target penetrator.

FIGS. 11-13 illustrate use of the munition 10 in a target penetration mode. In FIG. 11 the munition 10 is shown approaching a hard target 200. FIG. 12 shows the munition 10 impacting the hard target 200. Only the warhead 12, with its penetrator casing 34, is able to penetrate the hard target 200 to reach an inner area 202 of the hard target 200. The other parts of the munition, such as the airframe 14, the nose kit 24, and the tail kit 28, are destroyed and/or are separated from the warhead 12 by the collision with the hard target 200.

FIG. 13 illustrates the fragmentation effect of the warhead 12 after penetration. The illustration shows the situation after the explosive 36 has been detonated. Fragments 210 are spread within the hard target inner area 202 by the explosion. The fragments 210 include fragments produced by the destruction of the penetration casing 34, and perhaps other preformed fragments that were located in the holes 68 within the casing 34. The fragments between the casing 34 and the airframe 14 (FIG. 2) may also be part of the fragments 210.

Figure 14:
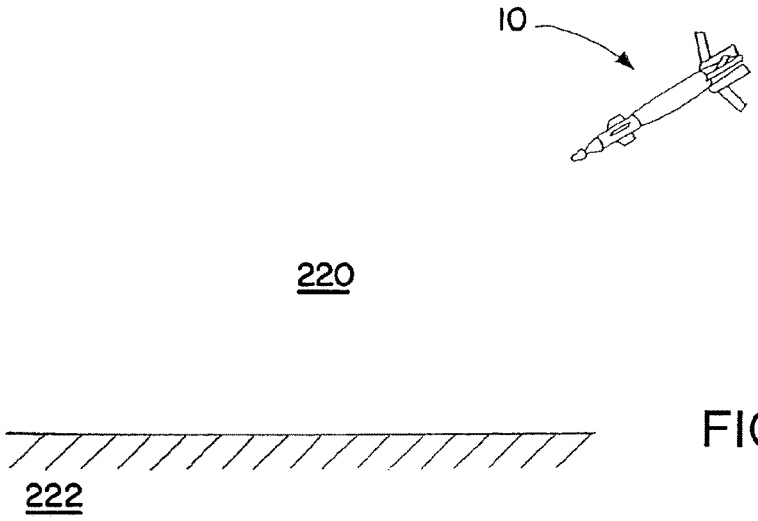
FIG. 14 is a side view illustrating a first step in the use of the munition of FIG. 1 in a fragmentation mode.
Figure 15:
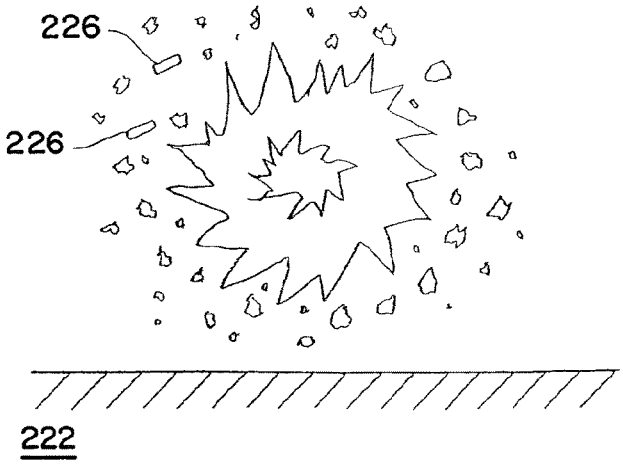
FIG. 15 is a side view illustrating a second step in the use of the munition in a fragmentation mode.

FIGS. 14 and 15 illustrate the use of the munition 10 as a fragmentation weapon, without penetration. FIG. 14 shows the munition 10 in a steep dive, approaching a desired detonation location 220 above the ground 222. The fuze 38 (FIG. 3) may be set to provide detonation at a desired height, and different heights may be used for different types of engagement (different types of soft targets, and spreads over different areas). As an example, the desired detonation location 220 may be 3-4 meters above the ground 222, although a wide variety of other detonation heights are possible.

FIG. 15 illustrates the detonation at the location 220. The detonation spreads fragments 126 about the area near the detonation location 220. As with the detonation illustrated in FIG. 13, the fragments 126 may include pieces of the penetrator casing 34 (FIG. 3), the preformed fragments 80 (FIG. 4), and the fragments between the casing 34 and the airframe 14. The fragmentation mode shown in FIGS. 14 and 15 may be useful for attacking soft targets that spread out to some degree, such as enemy personnel out in the open.

The enhanced fragmentation provided by the munition 10 may allow more effective engagement of both soft and hard targets, as well flexibility in using a single munition in multiple modes, by use of the fuze 38 to control whether detonation occurs at a height above ground, or only after penetration of a hard target. The target selection (the mode of hard versus soft, the fuze delay, and/or the height of bust control setting) may be controlled in any of multiple ways:

1) preset by the ground crew before weapon launch for some systems; 2) controlled from the aircraft or other launcher before weapon launch by the pilot or ground control for some systems; and/or 3) controlled after weapon launch via a data link.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A munition comprising:

a warhead that includes:

a casing; and an explosive within the casing; and an enclosure around the outside of the casing, enclosing the warhead;

wherein the enclosure includes solid fragments that are propelled outward when the explosive is detonated;

wherein the solid fragments are in pockets within the enclosure; and wherein the pockets are defined longitudinally by circumferentially-extending ribs of the enclosure.

2. The munition of claim 1, wherein the solid fragments are enclosed as parts of self-contained fragmentation packs that are located in the openings or pockets.

3. The munition of claim 2, wherein the fragmentation packs are flexible.

4. The munition of claim 2, wherein the fragmentation packs include a fragmentation pack casing that contains the fragments.

5. The munition of claim 4, wherein the fragmentation pack casing is a sealed fragmentation pack casing.

6. The munition of claim 4, wherein the fragmentation pack casing is a metal and/or plastic fragmentation pack casing.

7. The munition of claim 1, wherein the fragments are in cast fragment blocks that include multiple of the fragments held together by a binder.

8. The munition of claim 7, wherein the cast fragment blocks are adhesively secured to the enclosure.

9. The munition of claim 7, wherein the cast fragment blocks are mechanically secured to the enclosure.

10. The munition of claim 1 further comprising a metallic powder material within the enclosure.

11. The munition of claim 10, wherein the metallic powder material is aluminum, magnesium, zirconium or titanium.

12. The munition of claim 10, wherein the metallic powder material is incendiary material.

13. The munition of claim 10, wherein the metallic powder material is within a flexible bag or casing.

14. The munition of claim 1, wherein the enclosure is a clamshell enclosure.

15. The munition of claim 1, wherein the casing is a penetrator casing;

wherein the penetrator casing has a nose, and an aft section extending back from the nose;

wherein the penetrator casing has a series of elongate reduced-thickness portions, thinner than portions of the casing that are adjacent the reduced-thickness portions;

wherein the elongate reduced-thickness portions are non-intersecting elongate reduced-thickness portions;

wherein the reduced-thickness portions are parts of the aft section; and wherein the nose has a thickest portion that is at least twice the thickness of the portions of the casing that are adjacent the reduced-thickness portions.

16. The munition of claim 1, wherein the enclosure includes an upper piece and a lower piece that engage together to surround the warhead.

17. The munition of claim 16, wherein the upper piece is part of an upper assembly that also includes a nose ring and a tail ring, with the nose ring and the tail ring attached to the upper piece.

18. The munition of claim 16, wherein the upper piece and the lower piece each include multiple longitudinally-separated pockets.

19. The munition of claim 18, wherein the upper piece and the lower piece each include ribs between adjacent of the longitudinally-separated pockets.

20. The munition of claim 16, wherein the upper piece and the lower piece are made of aluminum.

21. A munition comprising:

a warhead that includes:

a casing; and an explosive within the casing; and an enclosure around the outside of the casing, enclosing the warhead;

wherein the enclosure includes solid fragments that are propelled outward when the explosive is detonated;

wherein the casing has a series of elongate reduced-thickness portions, thinner than portions of the casing that are adjacent the reduced-thickness portions; and wherein the elongate reduced-thickness portions are non-intersecting elongate reduced-thickness portions; and further comprising a lethality-enhancement material located at the reduced-thickness portions of the casing.

22. The munition of claim 21, wherein the lethality-enhancement material includes solid fragments that are projected by the warhead when the explosive is detonated.

23. The munition of claim 21, wherein the lethality-enhancement material includes an energetic material that releases energy when the explosive is detonated.

* * * * *